US009404355B2

(12) United States Patent
Bayliss

(10) Patent No.: US 9,404,355 B2
(45) Date of Patent: Aug. 2, 2016

(54) PATH TRACKING FOR DIRECTIONAL DRILLING AS APPLIED TO ATTITUDE HOLD AND TRAJECTORY FOLLOWING

(75) Inventor: Martin Thomas Bayliss, Stroud (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 262 days.

(21) Appl. No.: 14/233,133

(22) PCT Filed: Jul. 23, 2012

(86) PCT No.: PCT/US2012/047843

§ 371 (c)(1),
(2), (4) Date: Mar. 25, 2014

(87) PCT Pub. No.: WO2013/016282

PCT Pub. Date: Jan. 31, 2013

(65) Prior Publication Data

US 2014/0196950 A1 Jul. 17, 2014

Related U.S. Application Data

(60) Provisional application No. 61/510,592, filed on Jul. 22, 2011.

(51) Int. Cl.

| | |
|---|---|
| ***E21B 44/02*** | (2006.01) |
| ***E21B 7/04*** | (2006.01) |
| ***E21B 44/00*** | (2006.01) |
| ***E21B 47/022*** | (2012.01) |
| ***E21B 7/10*** | (2006.01) |

(52) U.S. Cl.

CPC . *E21B 44/02* (2013.01); *E21B 7/04* (2013.01); *E21B 7/10* (2013.01); *E21B 44/005* (2013.01); *E21B 47/022* (2013.01)

(58) Field of Classification Search

CPC ..... E21B 7/04; E21B 47/022; E21B 44/00; E21B 44/005; E21B 47/024; E21B 7/068; E21B 44/02; E21B 7/00; G01C 21/00

See application file for complete search history.

(56) References Cited

U.S. PATENT DOCUMENTS 4,828,050 A * 5/1989 Hashimoto ..... E21B 7/062 175/45
5,220,963 A * 6/1993 Patton ..... E21B 7/04 175/24

(Continued)

FOREIGN PATENT DOCUMENTS

EP 0695850 2/1996

OTHER PUBLICATIONS

D. Chwa, "Sliding-mode tracking control of nonholnomic wheeled mobile robots in polar coordinates," IEEE Transactions on Control Systems Technology, 12(4), 2004, 637-644.

(Continued)

*Primary Examiner* — Daniel P Stephenson

(57) ABSTRACT

A method for directional control of a drilling system includes generating a set point attitude on an outer loop to establish a path to be followed by the drilling system. The set point attitude may be generated using a surface controller based on inclination and azimuth measurements made at the drilling system and a measured depth of the drilling system. A downhole inclination and azimuth hold system is used on an inner loop to control drilling along the path established by the set point attitude. The inclination and azimuth hold system processes the set point attitude to compute a toolface control input and a dogleg severity control input which are applied to the drilling system to control the drilling system to drill along the established path.

13 Claims, 9 Drawing Sheets

(56) References Cited

U.S. PATENT DOCUMENTS

| | | | | |
|---|---|---|---|---|
| 5,390,748 | A * | 2/1995 | Goldman | E21B 7/04 175/24 |
| 6,467,557 | B1 * | 10/2002 | Krueger | E21B 4/18 175/104 |
| 8,996,396 | B2 * | 3/2015 | Benson | G06Q 10/06313 166/369 |
| 9,085,938 | B2 * | 7/2015 | Panchal | E21B 44/00 |
| 9,157,309 | B1 * | 10/2015 | Benson | E21B 47/024 |
| 9,279,318 | B2 * | 3/2016 | Hay | E21B 44/00 |
| 2003/0024738 | A1 | 2/2003 | Schuh | |
| 2009/0090555 | A1 | 4/2009 | Boone et al. | |
| 2009/0120690 | A1 | 5/2009 | Phillips | |
| 2011/0112802 | A1 * | 5/2011 | Wilson | E21B 7/04 703/1 |
| 2014/0196950 | A1 * | 7/2014 | Bayliss | E21B 44/005 175/27 |
| 2014/0374159 | A1 * | 12/2014 | McElhinney | E21B 7/04 175/45 |
| 2014/0379133 | A1 * | 12/2014 | Toma | E21B 44/00 700/275 |
| 2015/0247397 | A1 * | 9/2015 | Samuel | E21B 44/005 700/275 |
| 2015/0317585 | A1 * | 11/2015 | Panchal | E21B 47/022 705/7.23 |
| 2015/0337640 | A1 * | 11/2015 | Huang | G06F 17/5009 703/10 |
| 2015/0361725 | A1 * | 12/2015 | Ignova | E21B 7/04 175/27 |

OTHER PUBLICATIONS

A. Elnagar and A. Hussein, "On optimal contrained trajectory planning in 3D environments," Robotics and Autonomous Systems, 33(4), 2000, 195-206.

Z. Gong and C. Liu, "Optimization for multiobjective optimal control problem and its application in 3D horizontal wells," in Sixth World Congress on Intelligent Control and Automation (WCICA 2006), 1110-1113.

U. Hahne, G. Risdal, J. Ruszka, and L. Wahlen, "Integrated BHA concept of the latest generation rotary closed-loop system for hole sizes from 5 7/8" to 18 1/4"," in IADC/SPE Drilling Conference, 2004, 87168-MS. Dallas, TX.

A. Li, E. Feng, and Z. Gong, "An optimal control model and algorithm for the deviated well's trajectory planning," Applied Mathematical Modelling, 33(7), 2009, 3068-3075.

A. Li, E. Feng and X. Sun, "Stochastic optimal control and algorithm of the trajectory of horizontal wells," Journal of Computational and Applied Mathematics, 212(2), 2008, 419-430.

A. Li, E. Feng, and L. Wang, "Impulsive optimal control model for the trajectory of horizontal wells," Journal of Computational and Applied Mathematics, 223(2), 2009, 893-900.

J. Matheus and S. Naganathan, "Drilling automation: Novel trajectory control algorithms for RSS," in IADC/SPE Drilling Conference and Exhibition. New Orleans, LA. 2010.

N. Panchal, M. Bayliss and J. Whidborne, "Robust linear feedback control of attitude for directional drilling tools," in Proc. 13th IFAC Symposium on Automation in Mining, Mineral and Metal Processing, 2010, Cape Town.

E. Shokir, M. Emera, S. Eid, and A. Wally, "A New Optimisation Model for 3D Well Design," Oil & Gas Science and Technology—Rev, 59(3), 2004, 255-266.

J. Sugiura and S. Jones, "Automated steering and realtime drilling process monitoring optimizes rotary-steerable underreamer technology," in SPE/IADC World Drilling Conference and Exhibition, Berlin 2008.

H. Xu, J. Zhang, and C. Jiang, "Directional Trajectory Control Employing Statistics and Probability Methods," in SPE International Meeting on Petroleum Engineering. Beijing, 1992.

* cited by examiner

PATH TRACKING FOR DIRECTIONAL DRILLING AS APPLIED TO ATTITUDE HOLD AND TRAJECTORY FOLLOWING

FIELD OF THE INVENTION

Aspects relate to directional drilling for wellbores. More specifically, aspects relate to directional drilling where control of the drilling procedure is used to develop path tracking for both path following and attitude hold applications.

BACKGROUND INFORMATION

Directional drilling is an important aspect of discovery of petroleum products in geotechnical formations. Directional drilling naturally gives rise to the requirement to autonomously control the attitude and trajectory of wells being drilled. Drivers may be used to control the drilling in order to maximize economic return of the drilling. Practical drivers for this include drivers that reduce well tortuosity due to target attitude overshoot as well as well collision avoidance. Conventional systems have proposed applications that enable sliding mode control to minimize errors in position and attitude. Other conventional technologies have approached path planning and trajectory following as an optimal control problem where researchers have tackled the problem using generic algorithms.

It is also the case that it is required to follow a predefined well plan as closely as possible, where the well plan has been optimally constructed off-line to minimize the measured depth of drilling given a set of target coordinates and drilling constraints, however conventional technologies have significant difficulties in achieving this result. There is a need to provide for directional drilling methods and apparatus such that control of the drilling procedure is used to develop path tracking for both path following and attitude hold applications.

DETAILED DESCRIPTION

In one aspect, a driver is described to provide for drilling control for exploration of geotechnical features. In the illustrated examples that follow, the methodologies may be conducted such that they may be contained on a computer readable medium, for example, or may be installed in a computer readable medium such as a hard disk for control of drilling functions. In some aspects, simulations may be run to allow an operator to preview the actions to be chosen. In other aspects, direct control of the drilling apparatus may be accomplished by the methodologies and apparatus described. In one example embodiment, a model is used, derived from kinematic considerations. In this simplified model, lateral and torsional dynamics of the drill string and the bottom hole assembly, (hereinafter called "BHA") are ignored. In this specific example embodiment provided:

$$\dot{\theta}_{inc} = V_{rop}(U_{dls}\cos U_{tf} - V_{dr}) \quad \text{Equation 1}$$

$$\dot{\theta}_{azi} = \frac{V_{rop}}{\sin\theta_{inc}}(U_{dls}\sin U_{tf} - V_{dr}) \quad \text{Equation 2}$$

where:

$\theta_{inc}$ is the inclination angle $U_{tf}$ is the tool face angle control input $U_{dis}$ is the 'dog leg severity' or curvature $V_{dr}$ is the drop rate disturbance ($V_{dr}=\alpha \sin \theta_{inc}$)

$V_{tr}$ is the turn rate bias disturbance $V_{rop}$ is the rate of penetration and is an uncontrolled parameter In one example embodiment, transformations may be used, as presented in equations 3 and 4:

$$U_{tf}=A \text{ TAN } 2(u_{azi},u_{inc}) \quad \text{Equation 3}$$

$$U_{dis}=K_{dis}*\text{sqrt}((u_{azi})^2+(u_{inc})^2) \quad \text{Equation 4}$$

Ignoring the disturbances, the plant model simplifies to Equations 5 and 6 as disclosed below.

$$\theta_{inc}=V_{rop}K_{dis}u_{inc} \quad \text{Equation 5}$$

$$\theta_{azi}=V_{rop}/\sin \Theta_{inc}K_{dis}u_{azi} \quad \text{Equation 6}$$

The following two equations illustrate two PI ("proportional-integral") controllers for the inclination and azimuth hold control loop:

$$\mu_{inc}^{fb}=K_{pi}e_{inc}+K_{ii}\int_0^t e(\text{inc})dt \quad \text{Equation 7}$$

$$\mu_{azi}^{fb}=K_{ps}e_{azi}+K_{is}\int_0^t e(\text{azi})dt \quad \text{Equation 8}$$

In the above, $e_{inc}=r_{inc}-\theta_{inc}$ are the inclination and azimuth errors respectively. PI gains, for example, may be obtained through a method known as pole placement. The robustness of aspects of the control system to measure feedback delays, input quantization delay and parametric uncertainty of $V_{rop}$ and $K_{dis}$ may be determined through a small gain theorem, as a non-limiting embodiment.

Figure 1:
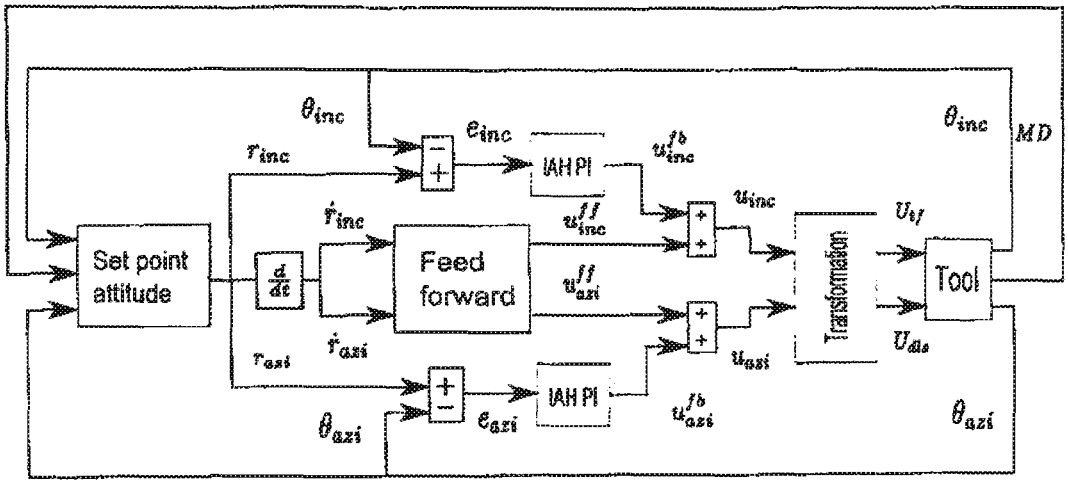
FIG. 1 is an architectural layout drawing of a general path tracking controller.

Referring to FIG. 1, an architecture for a general path tracking controller is illustrated. The illustrated embodiment has an inner loop and an outer-loop trajectory following controller. The inner loop controller is illustrated as modified by adding feed-forward terms to $U_{inc}$ and $U_{azi}$ as follows:

$$\mu_{inc}=\mu_{inc}^{ff}+\mu_{inc}^{fb}$$

$$\mu_{azi}=\mu_{azi}^{ff}+\mu_{azi}^{fb} \quad \text{Equation 9}$$

The feed forward terms are generated from an inversion of Equations 5 and 6 with $r_{inc}$ and $r_{azi}$ evaluated using numerical differentiation. The feed forward terms are used to reduce the initial response overshoot that would otherwise occur due to the unknown $V_{dr}$ and $V_{tr}$ disturbances requiring the IAH integral action to build up before the steady state error approached zero. In an alternative embodiment, the method may shift the dominant closed loop holes to speed up the response, but at the expense of stability. The feed forward, therefore, has the effect of speeding up the attitude response without destabilizing the overall controller action and the feedback action compensates for the un-model dynamics in the feed forward model inversion and uncertainty in the parameters used for the feedback control design.

In addition, with reference to FIG. 1, it can be seen that the described IAH tracks an attitude demand set point derived from the outer loop such that the tool is made recursively to track back from the tool position to the target position and attitude along a correction path. Both the attitude hold and trajectory following algorithms use the architecture shown in FIG. 1, the only difference between the two applications therefore being the internal content of the setpoint generator block shown in FIG. 1.

For both trajectory following and attitude hold, the setpoint attitude is evaluated at a higher update rate and then the sample is held recursively over each drilling cycle as the demand to be passed to the IAH. The trajectory following and attitude hold algorithm functionality will be split such that the attitude generator will be implemented on the surface while the IAH will be implemented autonomously downhole. The tool attitude is fed back from downhole to the surface and the measured depth, MD, is also fed back from a surface measurement. For both applications, the update rates for the algorithms described are in the order of 10 seconds for the feedback measurements and controllers, while drilling cycle periods on the order of multiples of minutes, as a non-limiting embodiment.

Figure 2:
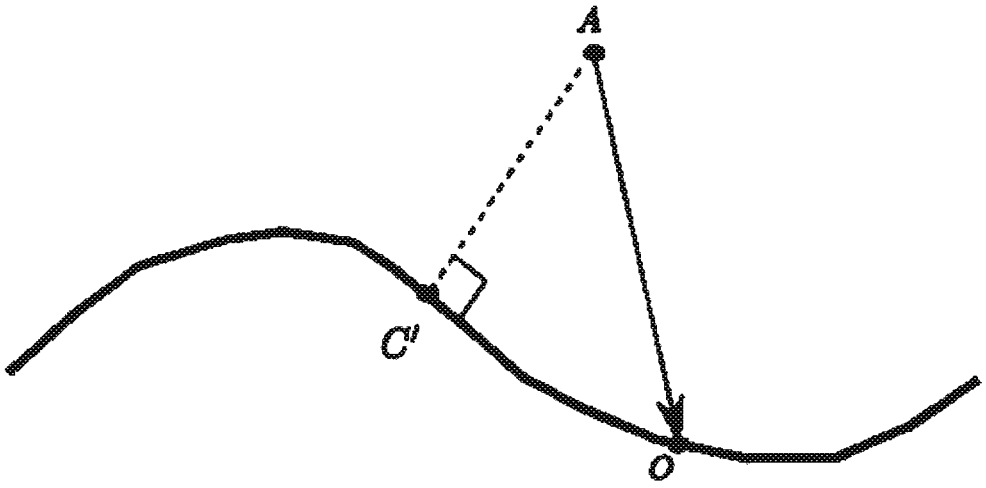
FIG. 2 is a side view of a geometry for a preview point evaluation, in a trajectory following application.

The trajectory following algorithm requires a method to fit a setpoint attitude providing a correction path from the tool to the stored path position and attitude over a number of recursion cycles. The correction path is constructed by providing a demand attitude, defined as the attitude of the vector joining the tool position (point A) and appoint at some preview position along the plant path, point O, from the closest point of the tool to the stored path, point C', as shown schematically FIG. 2. This error vector is then taken as the setpoint attitude both for feed forward and feedback control of the tool attitude.

From the global coordinates of points A and O, the attitude in terms of azimuth and inclination are evaluated using the following Cartesian to spherical coordinate transformations:

$$\theta_{azi} = \operatorname{atan}\left(\frac{\Delta z}{\Delta y}\right) \qquad \text{Equation 10}$$

$$\theta_{inc} = \operatorname{atan}\left(\frac{\rho}{\Delta y}\right)$$

$$\rho = hypot(\Delta y, \Delta z)$$

Note that for the transformation stated above in equation 10 for the fixed global coordinate system, the assumed sign convention is a right-handed coordinate system with the X axis pointing vertically down. As will be understood, other conventions and transformations may be used. In the above described algorithm, the algorithm recursively converges over several drilling cycles until the error vector from points A to O approximates to being parallel to the stored path and the normal path from point C' to A in FIG. 2 approaches zero length.

For attitude hold, where the tool is required to track a fixed azimuth and inclination, it is possible to modify the trajectory following algorithm by generating the target path on-line and using a different methodology to generate the demand attitude vector optimally in the sense that the set point trajectory can be constructed to have a specified nominal absolute curvature. The target path is generated online based on the target azimuth and inclination and nominal $V_{rop}$:

$$\dot{x} = V_{rop}\cos(\theta_{inc})$$

$$\dot{y} = V_{rop}\cos(\theta_{azi})\sin(\theta_{inc})$$

$$\dot{z} = V_{rop}\sin(\theta_{inc})\sin(\theta_{azi}) \qquad \text{Equation 11}$$

Equation 11 is then numerically integrated using the starting position of the attitude hold section as initial conditions to obtain the target path. Note that the assumption is made that the coordinates of the initial plan position in the beginning of the attitude hold section are coincident. The hold algorithm therefore can be seen to predict the path following target path from a given position with the required attitude.

Figure 3:
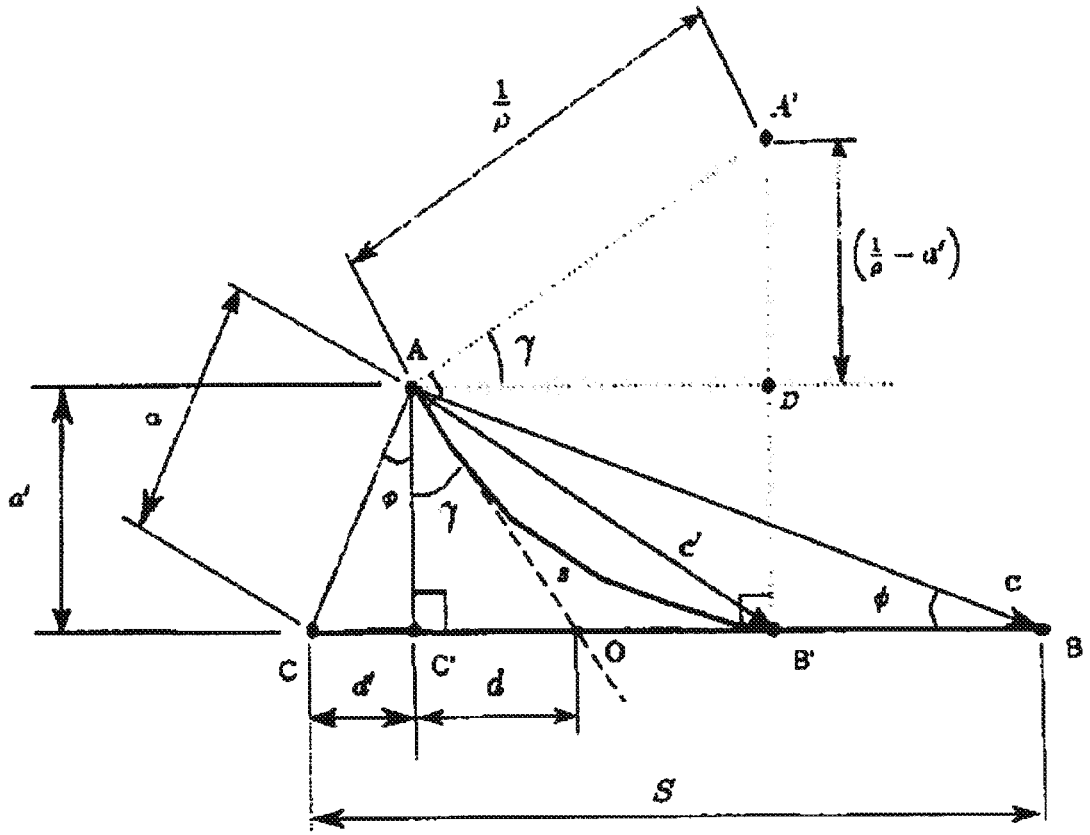
FIG. 3 is a side view of a geometry for a preview point evaluation, in an attitude hold application.

Referring to FIG. 3, the demand attitude to pass the inner IAH feedback loop is taken as the attitude of the start tangent to a curve fitted between the tool position A and the intersection of a correction path of absolute curvature ρ with the predicted target path, also at tangent (point B'). In FIG. 3, point C is a point on the target path several sample periods prior to the point of minimum distance between the tool (point A) and the target path, labeled as point C'. Point B is a point arbitrarily along the target path from point C. With this planar geometry two assumptions are made, these being 1) angle CAB is 90° 2) AC'B and AC' C are similar triangles. The objective, therefore is to define the Cartesian coordinates of the vector joining points A (the tool) and point O (the intersection of the start tangent of the correction path with the target path). The vector joining points A and O then define recursively the demand attitude for the inner IAH feedback loop as evaluated from equation 10 previously. With these objectives and assumptions, the geometric construction proceeds as described below.

The Cartesian components of the target path tangent are evaluated from the backward difference of the on-line generated target path derived from Equation 11 factored by an arbitrary preview distance S as follows.

$$L_i S\left(\frac{\Delta_i}{\|\Delta_i\|_2}\right), \qquad \text{Equation 12}$$

$$i = x, y, z$$

Where $\Delta=\{x_n-x_n-1, y_n-y_n-1, z_n-z_n-1\}^t$.

A preview point B can be defined by projecting the arbitrary preview distance S (where distance S>>d+d') ahead of point C as follows:

$$B_i = C_i + L_i,$$

$$i = x, y, z \qquad \text{Equation 13}$$

A vector c can be defined joining point A and the arbitrary preview point B on the target path. Using the right angled approximation for angle CAR it can deduced that:

$$\alpha = \sqrt{S^2 + |c|^2} \qquad \text{Equation 14}$$

where:

$$|c| = \|((Bx_i) - (Ax_i))\|_2,$$

$$i = x, y, z \qquad \text{Equation 15}$$

To solve for dimension a' it can be deduced using the similar triangles approximation (AC' B & AC' C) that:

$$a' = a\cos\phi, \qquad \text{Equation 16}$$

$$\phi = a\cos\left(\frac{|c|}{S}\right)$$

With reference to FIG. 3 dimension d from points C' to O can be evaluated by noting points A and B' or on a curve with curvature ρ and a common center of curvature $A^t$. With the construction shown (similar triangles ADA' and AC'O) it can be deduced that:

$$d = a\tan\gamma \qquad \text{Equation 17}$$

Where $$\gamma = a\sin(1 - a'\rho) \qquad \text{Equation 18}$$

Dimension d' is evaluated as:

$$d = \alpha\sin\phi \qquad \text{Equation 19}$$

As a result, dimension d+d' can be used to find the coordinates of point O relative to point C enabling the attitude of the vector from point A to point O to be evaluated.

The preceding attitude and trajectory control algorithms were tested using a drilling simulator. The simulator used Equations 1 and 2 as the plant model was able to feed $U_{dis}$ and $U_{tf}$ commands to the plant either from a well-planned with respect to measured depth open loop or from the prototype closed loop trajectory following or attitude hold algorithms. In the example embodiment, the drilling simulator transformed the $\theta_{inc}$ and $\theta_{azi}$ responses from the plant into globally reference Cartesian coordinates for automated steering introductory response display purposes.

The plant attitude response and globally referenced gravity and magnetic field vectors are used to simulate three axis magnetometer and accelerometer sensor signals as typically used for attitude sensing arrangements. The signals are signal conditioned in order to generate attitude feedback signals for automated steering. In the example embodiment, the drilling simulator includes realistic engineering constraints such as the drilling cycle, attitude measurement feedback delays, input dynamics as well as noise. The relevant drilling and model parameters in the example are shown in Table 1. The two cases simulated are attitude hold and trajectory following. To demonstrate a practical feature of the attitude hold algorithm that is required in the field at between 600 and 1200 feet of measured depth the tool is positioned in the inclinations so that the target inclination changes to 93° and then back to 90° to simulate the typical on-line adjustments made by the directional driller when following a geological feature. The trajectory following test case uses the same parameters in initial conditions as the attitude hold test case with the exception that rather than the target path being generated online, a stored path is used instead. The stored path was created such that it had an 8° per 100 feet maximum curvature and the closed loop run assumed a tool with a 15° per hundred foot curvature capacity, providing a curvature tolerance between the path the tool followed and the curvature capacity of the tool.

TABLE 1

| TRANSIENT SIMULATION PARAMETERS | |
|---|---|
| $\theta_{inc}$, $\theta_{azi}$ | 90° 270° initial attitude respectively |
| $V_{rop}$ | 100 ft/hr with 20 ft/hr standard deviation noise |
| $K_{dls}$ | 15°/100 ft tool capacity & 8°/100 ft well plan |
| $h_{lag}$ | $U_{tf}$ dynamics |

TABLE 1-continued

| TRANSIENT SIMULATION PARAMETERS | |
|---|---|
| $h_1$ | feedback delay corresponding to 10 ft @ Vrop |
| $h_2$ | drilling cycle delay 90 s, equivalent to 180 s drilling cycle |
| $\omega_a$ | $2\pi/1.0 \times 10^4$ rad/s design θazi response natural frequency |
| $\omega_i$ | $2\pi/1.5 \times 10^4$ rad/s design θinc response natural frequency |
| Vdr | Drop rate bias 1.0°/100 ft |
| Vtr | Turn rate bias 0.5°/100 ft |
| Tz | Fixed step ode3 Bogaki-Shampine solver, 10 s step size |
| Preview | 30 & 3281 ft, trajectry following & attitude hold |

Figure 4:
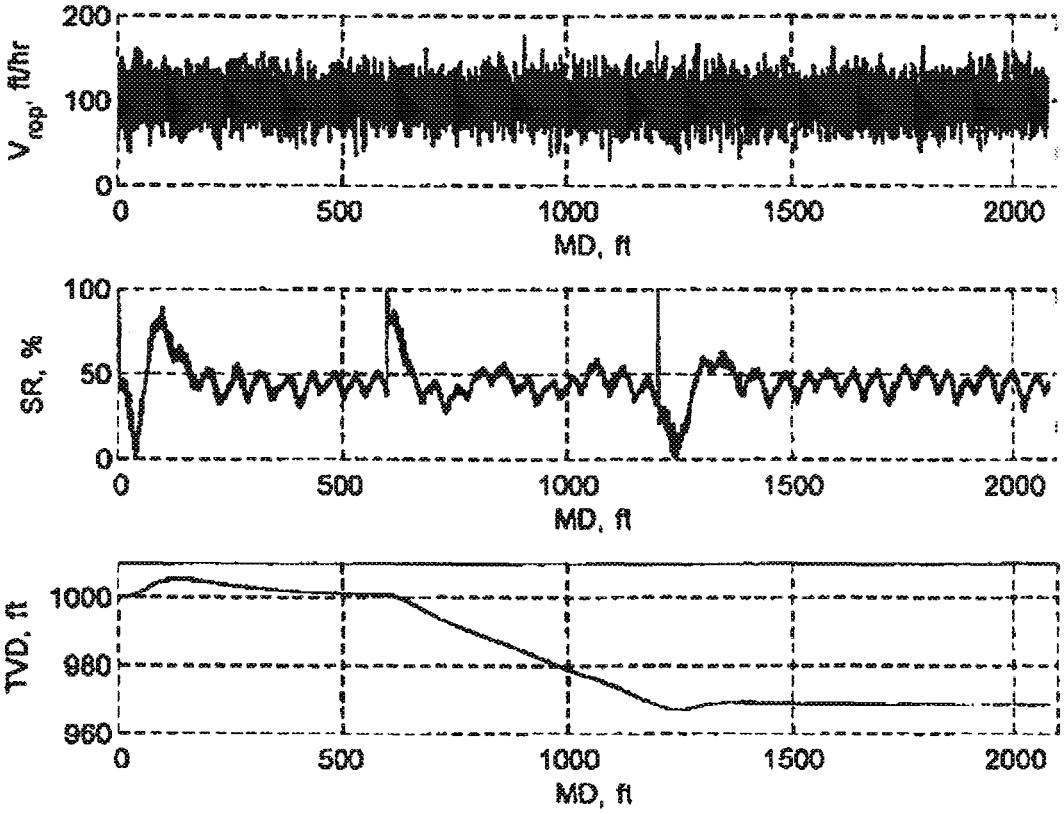
FIG. 4 is a series of three response plots from an attitude hold simulation, wherein a first plot shows a noisy $V_{rop}$ input into the model, a second plot shows the dogleg severity or curvature output from the attitude controller and a third plot illustrates the true vertical displacement response.

Referring to FIG. 4, three response plots from the method of attitude hold are presented. In the top plot illustrated, the noisy $V_{rop}$ input into the model is illustrated due to the 20 ft/hr standard deviation random noise added to the nominal 100 ft/hr. The middle plot shows the $U_{dis}$ output from the attitude controller, and it can be seen that apart from the beginning and end of the nudge section, the steering ratio is reasonably constant at around 50%, which is logical given the constant $V_{dr}$ and $V_{tr}$ at around 50% which is logical given the constant $V_{dr}$ & $V_{tr}$ disturbances. The lower plot shows the TVD (true vertical displacement) response which for attitude hold is a variable of interest. As presented, the TVD response for the first 600 feet where the inclination is held close to the start TVD but between 600 and 1200 feet the tool builds by 30 feet as the attitude hold maintains the tool at 93° inclination. After 1200 feet, the target inclination is again 90° and hence the tool remains at a same true vertical displacement.

Figure 5:
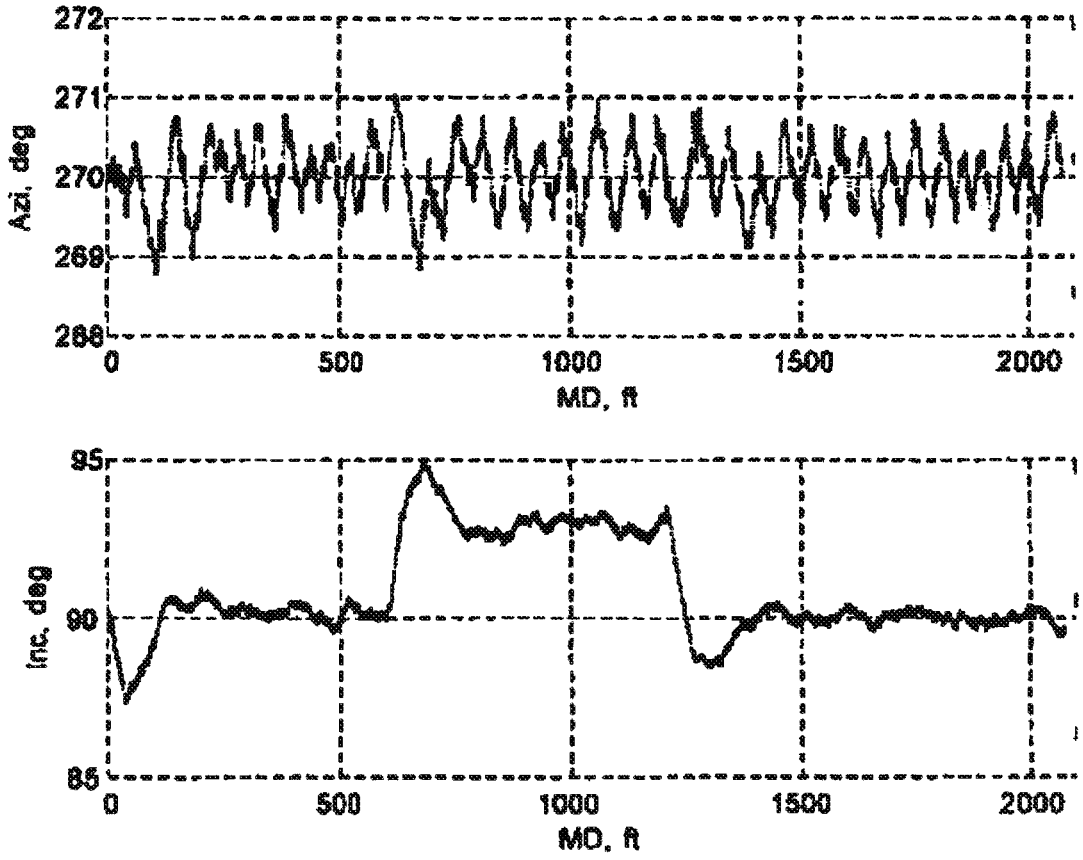
FIG. 5 is an attitude hold azimuth and inclination response.

Referring to FIG. 5, the attitude response for an attitude hold simulation is presented. The 3° attitude nudge can be seen between the 600 and 1200 foot level where the inclination changes from 90° to 93° and back again while the azimuth is maintained at 270°±1°.

Figure 6:
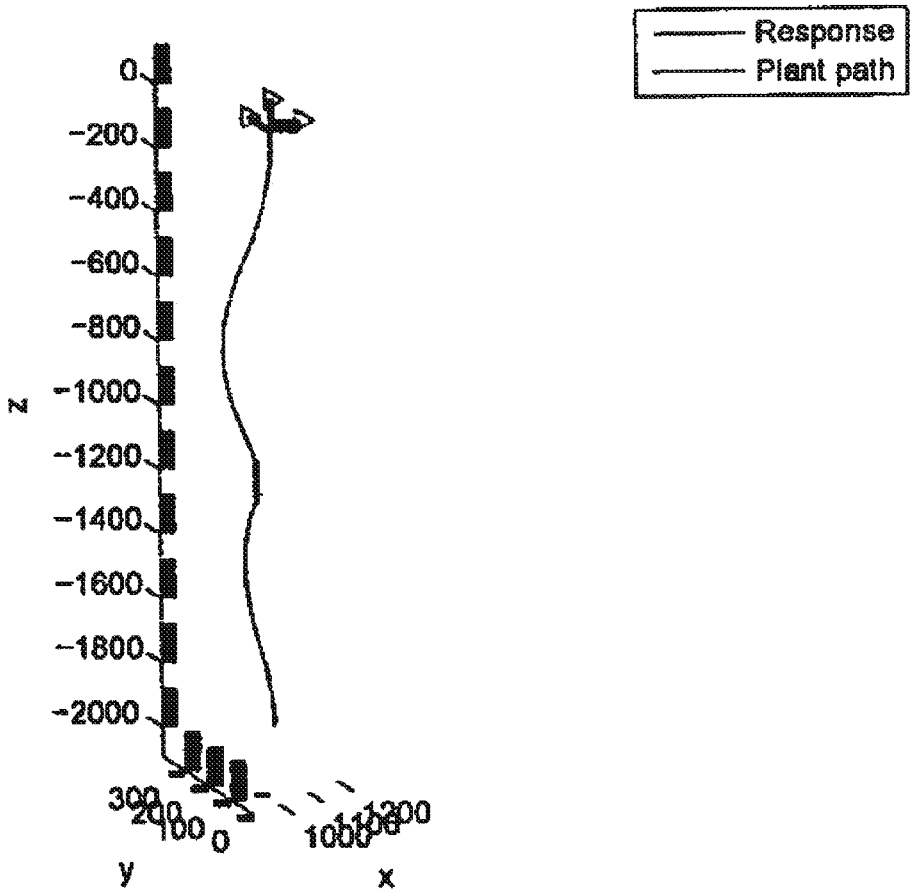
FIG. 6 is a graph of a trajectory following response using an aspect described.

Referring to FIG. 6, a trajectory following simulation response is illustrated with the response tracking the stored path trajectory well. In the illustrated embodiment, the positive direction for the global coordinate system axes are shown at the start of the stored path trajectory. As presented, the tool mostly drilled in the negative z-axis direction with the azimuth being close to 270°.

In the illustrated embodiment, the drilling simulator used for the fixed global reference frame is a right-handed coordinate system with the X axis pointing vertically down. For these simulations, the dipping inclination angles of the magnetic field vector were assumed zero such that the magnetic field vector was parallel to the positive y-axis and the gravitational field vector was taken as being parallel to the positive X axis of the fixed global coordinate system respectively.

Figure 7:
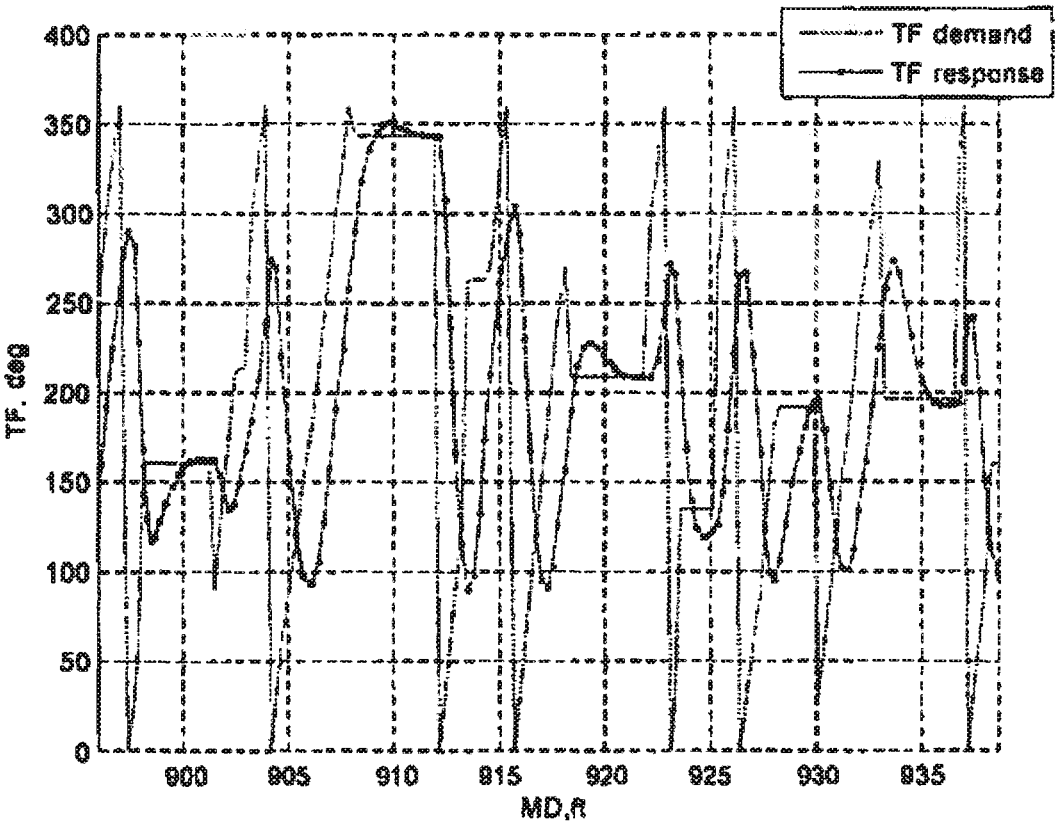
FIG. 7 is a trajectory following tool face response in a zoomed view using an aspect described.

Referring to FIG. 7, a zoomed view of the tool face control output and response for the trajectory following simulation is presented. In FIG. 7, for example, it can be seen that the input tool face dynamics indicate that there is a considerable difference between the demand from the trajectory following algorithm and the response due to the tool face lag. From the trajectory following algorithm in FIG. 6, however, the system is acceptable despite the tool face lag.

Figure 8:
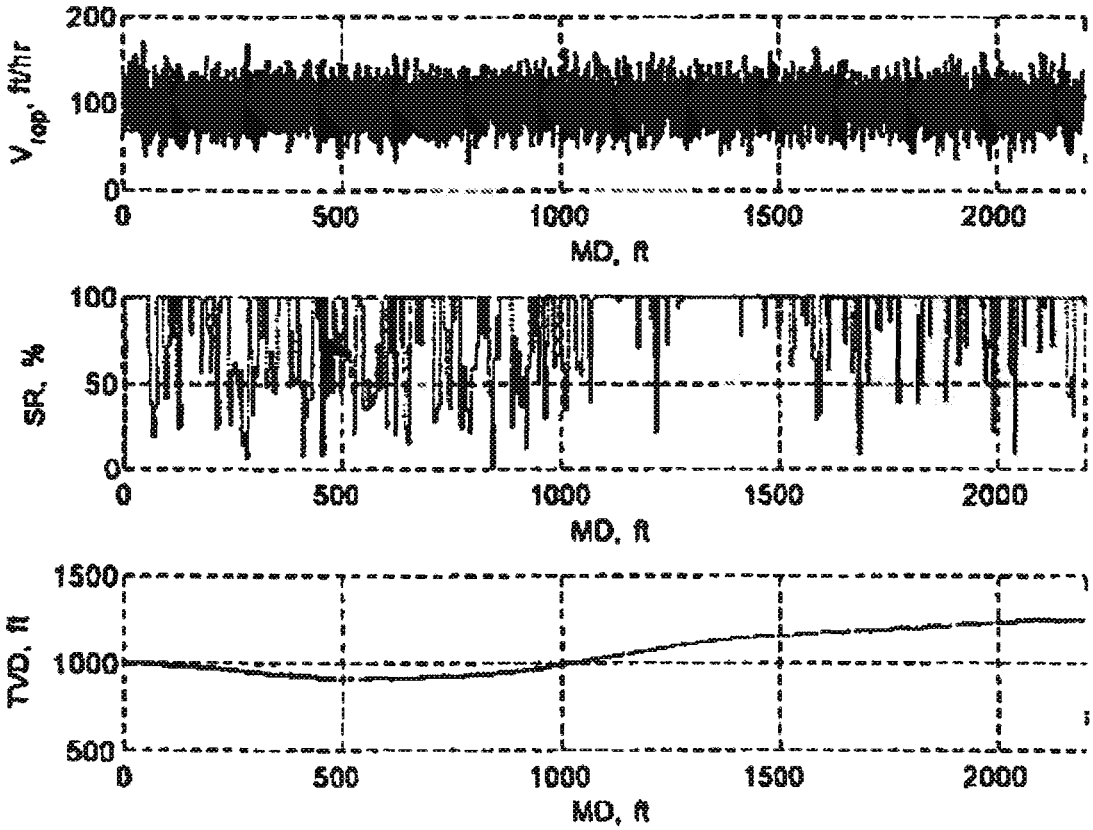
FIG. 8 is a trajectory following $V_{rop}$, SR and TVD response.
Figure 9:
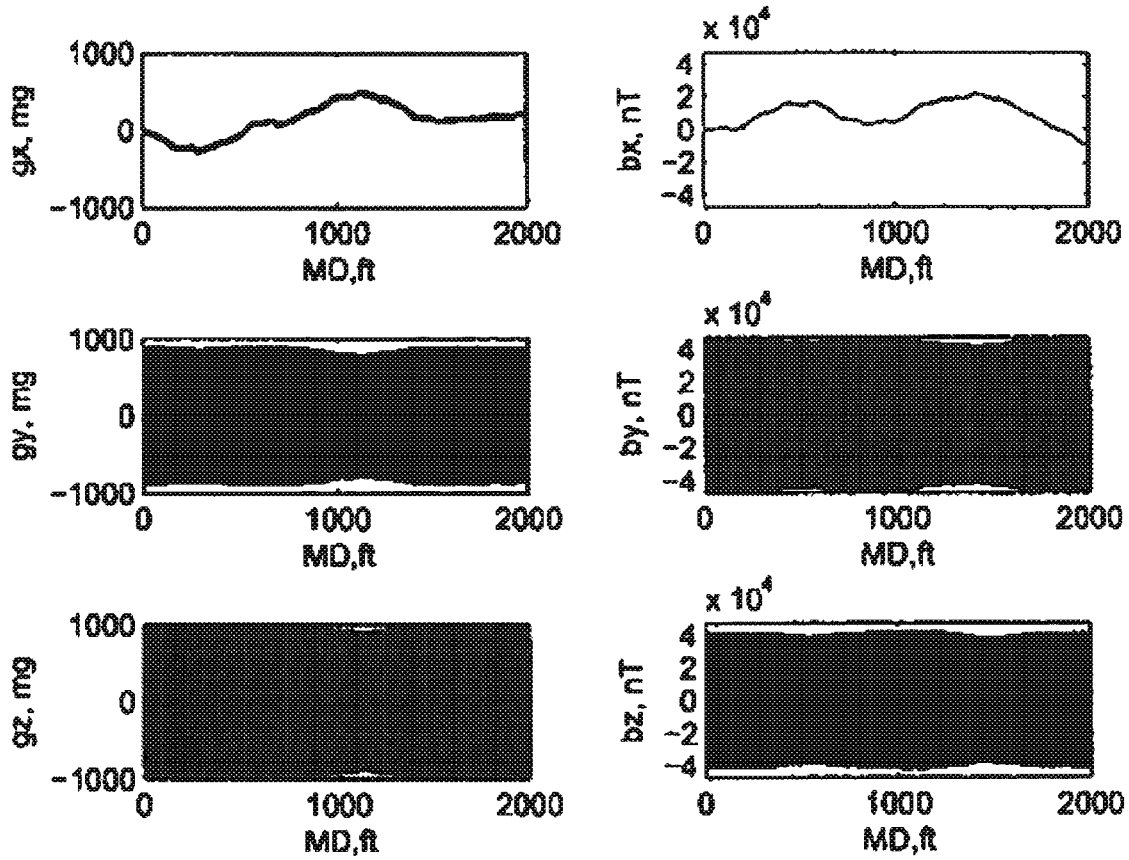
FIG. 9 is a series of trajectory following attitude sensor signals.

FIG. 8 shows similar plots as FIG. 4 but for a trajectory following simulation using one aspect of the disclosure. For this trajectory following simulation, there is more variation in steering ratio because although the $V_{dr}$ & $V_{tr}$ disturbances are still constant, the tool demand attitude is changing, hence leading to the varying average steering ratio over the simulation. The TVD (true vertical displacement) variation over the run can also be seen in the bottom plot of FIG. 8, only this is less significant this time as the response merely follows the TVD variation of the stored path trajectory. FIG. 9 illustrates the simulated accelerometer and magnetometer signals for the trajectory following simulation. The top two plots in FIG. 9 shows the on-tool axis aligned sensor response which is non-oscillatory and as expected small in magnitude due to the on tool axis sensors being mostly perpendicular to both the magnetic and gravitational fields. In the lower four plots in FIG. 9, however, which show the radio accelerometer and magnetometer signals, the collar rotation of the tool can be seen as the sensor signals oscillate at the collar rotation frequency at near plus minus full signal due to the orientation of the tool.

In one embodiment, a method for directional control of a drilling system is presented, comprising using an inclination and azimuth hold system to develop a path to be followed by the drilling system, wherein the inclination and azimuth hold system calculates a set point attitude (in terms of azimuth and inclination) recursively for a inner loop attitude tracking controller to follow such that the path generated is of a prescribed curvature (dogleg); and hence controlling the drilling system to drill along the generated path obtained by the inclination and azimuth hold system.

In another embodiment, the method may further comprise controlling an attitude of the path to be followed by the drilling system.

In another embodiment, the method may be performed wherein the attitude of the path to be followed by the drilling system is based on a target azimuth and inclination and nominal rate of penetration.

In another embodiment, the method may further comprise tracking the path obtained by the inclination and azimuth hold system.

In another embodiment, the method may further comprise displaying the path obtained by the inclination and azimuth hold system.

In another embodiment the method may further comprise feeding back signals from the drilling system drilling along the path obtained by the inclination and azimuth hold system to develop a revised path developed by the inclination and azimuth hold system.

In a still further embodiment, the method may further comprise obtaining a true vertical displacement response from a bottom hole assembly during the controlling the drilling system to drill along the path obtained by the inclination and azimuth hold system.

In another embodiment, the method may further comprise displaying the true vertical displacement response of the bottom hole assembly.

In another embodiment, the method may further comprise displaying the path to be followed by the drilling system and displaying an actual path followed by the drilling system.

It will be understood that recursive variable horizon trajectory control for directional drilling may be used in embodiments described. This trajectory control may use elliptical helixes, as a non-limiting embodiment. In certain embodiments, MPC strategy may be used. Direction and inclination sensors and a rate of penetration may be used to determine a spatial position. In embodiments, a set-point trajectory may be set which meets a horizon. The set-point trajectory, for example, may be dependent on using a method to fit a curve from a tool's position to one of a path which satisfies curvature constraints. Once this position is available, a curve may be toted which joins points and matches tangents. Such curves may be elliptical helix curves.

While the aspects described have been disclosed with respect to a limited number of embodiments, those skills in the art, having the benefit of this disclosure, will appreciate numerous modifications and variations therefrom. It is intended that the appended claims cover such modifications and variations as within the true spirit and scope of the aspects described.

What is claimed is:

1. A method for directional control of a drilling system, comprising:

generating a set point attitude on an outer loop to establish a path to be followed by the drilling system, the set point attitude generated using a surface controller based on inclination and azimuth measurements made at the drilling system and a measured depth of the drilling system;

using a downhole inclination and azimuth hold system on an inner loop to control drilling along the path established by the set point attitude, wherein the inclination and azimuth hold system processes the set point attitude to compute a toolface control input and a dogleg severity control input; and applying the toolface control input and the dogleg severity control input to the drilling system to control the drilling system to drill along the established path.

2. The method according to claim 1, wherein the set point attitude is generated based on a target azimuth and inclination and nominal rate of penetration.

3. The method according to claim 1, wherein using a downhole inclination and azimuth hold system on an inner loop further comprises: (i) combining the set point attitude and a measured drilling attitude to compute an attitude error; (ii) processing the attitude error using a proportional integral controller to compute a feedback attitude; (iii) summing the feedback attitude with a feed forward attitude to obtain an input attitude; and (iv) transforming the input attitude to compute the toolface control input and the dogleg severity control input.

4. The method according to claim 1, further comprising:

obtaining a true vertical displacement response from a bottom hole assembly during the controlling the drilling system to drill along the path.

5. The method according to claim 4, further comprising:

displaying the true vertical displacement response of the bottom hole assembly.

6. The method according to claim 1, further comprising:

displaying the path to be followed by the drilling system; and displaying an actual path followed by the drilling system.

7. A method for directional control of a drilling system, comprising:

(a) causing a drilling tool to drill a subterranean wellbore (b) receiving a set point attitude at a downhole controller;

(c) measuring a drilling attitude at a downhole tool;

(d) combining the set point attitude and the drilling attitude to compute an attitude error;

(e) processing the attitude error using a proportional integral controller to compute a feedback attitude;

(f) summing the feedback attitude with a feed forward attitude to obtain an input attitude;

(g) transforming the input attitude to compute a toolface control input and a dogleg severity control input; and (h) applying toolface control input and the dogleg severity control input to the drilling tool while drilling.

8. The method of claim 7, further comprising:

(i) continuously repeating (c), (d), (e), (f), (g), and (h) while drilling in (a).

9. The method of claim 7, wherein:

(b) comprises receiving a set point inclination and a set point azimuth at the downhole controller;

(c) comprises measuring a drilling inclination and a drilling azimuth at the downhole tool;

(d) comprises combining the set point inclination and the drilling inclination to compute an inclination error and combining the set point azimuth and the drilling azimuth to compute an azimuth error;

(e) comprises processing the inclination error using a proportional integral controller to compute a feedback inclination and processing the azimuth error a proportional integral controller to compute a feedback azimuth;

(f) comprises summing the feedback inclination with a feed forward inclination to obtain an input inclination and summing the feedback azimuth with a feed forward azimuth to obtain an input azimuth; and (g) comprises transforming the input inclination and the input azimuth to compute the toolface control input and the dogleg severity control input.

10. The method of claim 7, wherein the set point attitude is received from a surface location in (b).

11. The method of claim 10, wherein the set point attitude is generated based on inclination and azimuth measurements made at the drilling system and a measured depth of the drilling system.

12. The method of claim 7, wherein the feed forward attitude is obtained by evaluating a first derivative of the set point attitude.

13. The method of claim 7, further comprising:

(i) transmitting the drilling attitude measured in (c) to a set point attitude controller; and (j) using the set point attitude controller to process the drilling attitude and a measured depth to compute a new set point attitude.

* * * * *